US006631809B2

(12) United States Patent
Gabl et al.

(10) Patent No.: US 6,631,809 B2
(45) Date of Patent: Oct. 14, 2003

(54) SCREEN FOR CLEANING A PULP SUSPENSION

(75) Inventors: Helmuth Gabl, Graz (AT); Axel Pichler, Graz (AT); Alexander Gscheider, Hohentauern (AT)

(73) Assignee: Andritz AG, Graz (AT)

( * ) Notice: Subject to any disclaimer, the term of this patent is extended or adjusted under 35 U.S.C. 154(b) by 10 days.

(21) Appl. No.: 09/776,258

(22) Filed: Feb. 2, 2001

(65) Prior Publication Data

US 2001/0022284 A1 Sep. 20, 2001

(30) Foreign Application Priority Data

Feb. 3, 2000 (AU) ..... 170/2000

(51) Int. Cl.[7] ..... B07B 1/22

(52) U.S. Cl. ..... 209/270; 209/273; 209/306; 210/413

(58) Field of Search ..... 209/270, 273, 209/281, 283, 300, 305, 306, 379, 385, 389; 210/413, 414, 415

(56) References Cited

U.S. PATENT DOCUMENTS

| | | | | |
|---|---|---|---|---|
| 3,053,391 A | | 9/1962 | Nelson | 201/304 |
| 4,268,381 A | * | 5/1981 | Hooper | 209/273 |
| 5,061,370 A | * | 10/1991 | Ferland et al. | 210/414 X |
| 5,318,186 A | * | 6/1994 | Rienecker | 209/306 X |
| 5,575,395 A | * | 11/1996 | Alajaaski et al. | 209/270 X |

FOREIGN PATENT DOCUMENTS

| | | | | |
|---|---|---|---|---|
| EP | 0 541 979 A | | 5/1993 | |
| EP | 0 795 641 A | | 9/1997 | |
| EP | 0 955 406 A | | 11/1999 | |
| SU | 606635 | * | 5/1978 | 209/273 |
| WO | WO 97 41296 A | | 11/1997 | |
| WO | WO 99 45193 A | | 9/1999 | |

OTHER PUBLICATIONS

EPO Search Report EP 1 124 003 A3, dated Oct. 2, 2001.

* cited by examiner

*Primary Examiner*—Tuan N. Nguyen
(74) *Attorney, Agent, or Firm*—Alix, Yale & Ristas, LLP

(57) ABSTRACT

A screen for cleaning a pulp suspension includes a stationary installation in the infeed area between the infeed branch and the free end of the rotor.

18 Claims, 7 Drawing Sheets

SCREEN FOR CLEANING A PULP SUSPENSION

BACKGROUND OF THE INVENTION

This invention relates generally to apparatus for cleaning pulp suspensions. More particularly, the present invention relates to screens for cleaning pulp suspensions.

Screens are machines used in the paper industry for the purpose of cleaning a pulp suspension consisting of water, fibers and dirt particles. In doing so, a feed flow is led over a screening device, with the accept stream consisting of water and fibers through the screen. A partial stream, called the reject stream, consisting of water, fibers and dirt particles, is generally withdrawn from the end located opposite the feed end. Generally speaking, such a screen is designed rotationally symmetrically and consists of a casing with a tangentially arranged infeed, a cylindrical screen basket, mostly with holes or vertical slots, and a revolving rotor. The rotor has the task of keeping the screen slots clear, and this is achieved by blades which rotate just below the screen surface. The accept stream is collected in an accept chamber, often one of a conical design, and extracted radially at some point. The reject stream is generally led to the end of the screen basket opposite the infeed into a reject chamber, which is in most cases annular, and extracted from the chamber tangentially. Such a screen is known for instance from U.S. Pat. No. 4,268,381. The disadvantage of these screening machines consists in the risk of clogging at low flow rates occurring in the relatively large reject chamber. Also, non-uniform inflow into the screen basket and non-uniform flow conditions in the accept chamber, especially in the area of the accept discharge, occur,

SUMMARY OF THE INVENTION

The purpose of the invention is, therefore, to create an improvement of the flow conditions in the screen in order to decrease the energy used at increased production rate and dirt removal.

The invention is therefore characterized by a stationary installation, which may be designed rotationally symmetrically, being provided in the infeed area between the tube branch and the end of the rotor. This gives a substantial improvement of the flow conditions and as a consequence, a reduction of the amount of energy used.

An advantageous advancement of the invention is characterized by the installation being a cone, a truncated cone, a hemisphere, a spherical segment, spheric segment between two parallel circles, a paraboloid, or a hyperboloid of two sheets.

A favorable variant of the invention is characterized by the cone angle a amounting to between 10° and 60° for installations designed as a cone or truncated cone.

A favorable advancement of the invention is characterized by the axis of the infeed branch being arranged in parallel to the cone shell. This allows better routing of the flow and further reduction of the energy losses.

A favorable, alternative variant of the invention is characterized by the installation being a spiral-shaped body, with the pitch of the spiral being selectable such that the flow speed in the infeed area is kept constant over the entire screen basket width.

An advantageous advancement of the invention is characterized by the installation being arranged centrally.

An advantageous variant of the invention is characterized by the accept chamber being designed double-conically.

An advantageous advancement of the invention is characterized by the screen being designed as double machine.

A favorable advancement of the invention is characterized by the infeed taking place axially through the rotor.

A favorable variant of the invention is characterized by the drive-side rotor part being of the same height as or higher than the rotor part on the other side of the drive into which and through which the pulp flows.

A favorable variant of the invention is characterized by the infeed taking place centrally from the side.

An advantageous advancement of the invention is characterized by two accept discharges being provided.

An advantageous variant of the invention is characterized by the screen being arranged horizontally.

A favorable advancement of the invention is characterized by a screen basket for preliminary screening, which turns together with the rotor, being provided in the infeed area, with rotating blades possibly being provided in the preliminary screening area.

A favorable advancement of the invention is characterized by the rotor having several blades arranged at different heights and/or distributed over the circumference.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
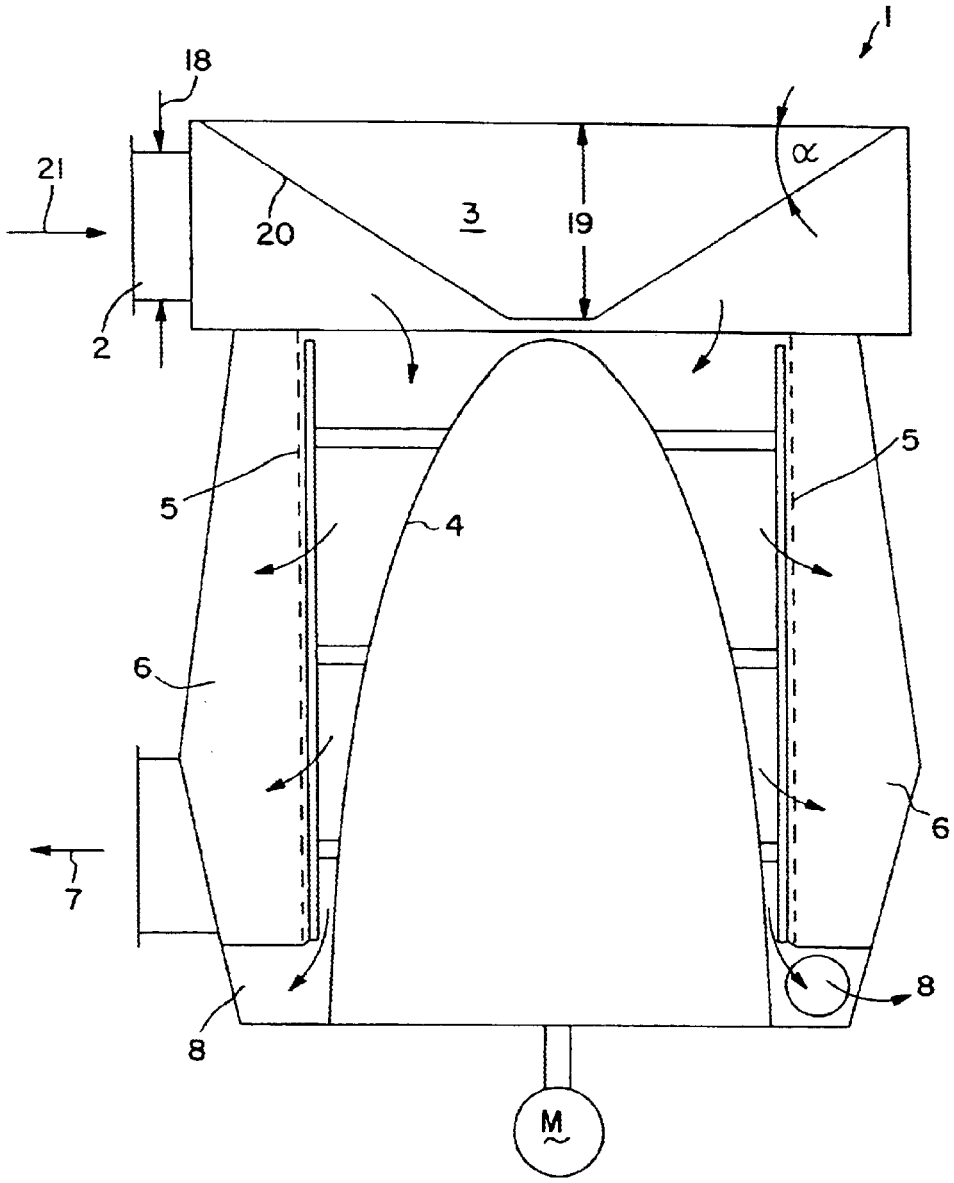
FIG. 1 is a cross-section view of a first embodiment of the invention.

FIG. 1 shows a screen 1, to which a pulp suspension is fed through an infeed branch 2 for cleaning, the infeed branch 2 having a diameter 18. In the area of the infeed, an installation 3 is provided, which is shown as a truncated cone having a height 19 which is substantially equal to diameter 18. The "top" of the truncated cone points in the direction of the rotor 4. Installation 3 may have a hollow or a filled body. To optimize deflection, the flank angle $\alpha$ of the surface 20 of the truncated cone is between 10° and 60° and the infeed branch 2 directs the inflow of pulp suspension 21 over substantially the full height of surface 20. The pulp suspension enters at the area between rotor 4 and screen plate 5 and is fed to the accept chamber 6 through the screen plate. The casing of the accept chamber is designed as a double cone, i.e. the casing tapers conically from about the upper edge of the accept outlet 7 toward the reject chamber, with the angle of the accept chamber being designed in view of a constant flow speed at an assumed uniform discharge through the screen plate.

For this, the rotor 4 of the screen 1 is designed for uniform screen inflow, which necessitates lower thickening behavior along the screen plate height. It is shaped as a parabola, and this means that the axial flow rate inside the screen basket remains constant at an assumed uniform outflow through the screen plate. As an alternative, the shape of the rotor may be approached through a conical shape.

To ensure suitable discharge of the reject flow, the reject chamber is designed such that flow rates above 2.5 m/sec. with or without additional introduction of agitating energy by the rotor are achieved. This virtually avoids clogging.

Figure 2:
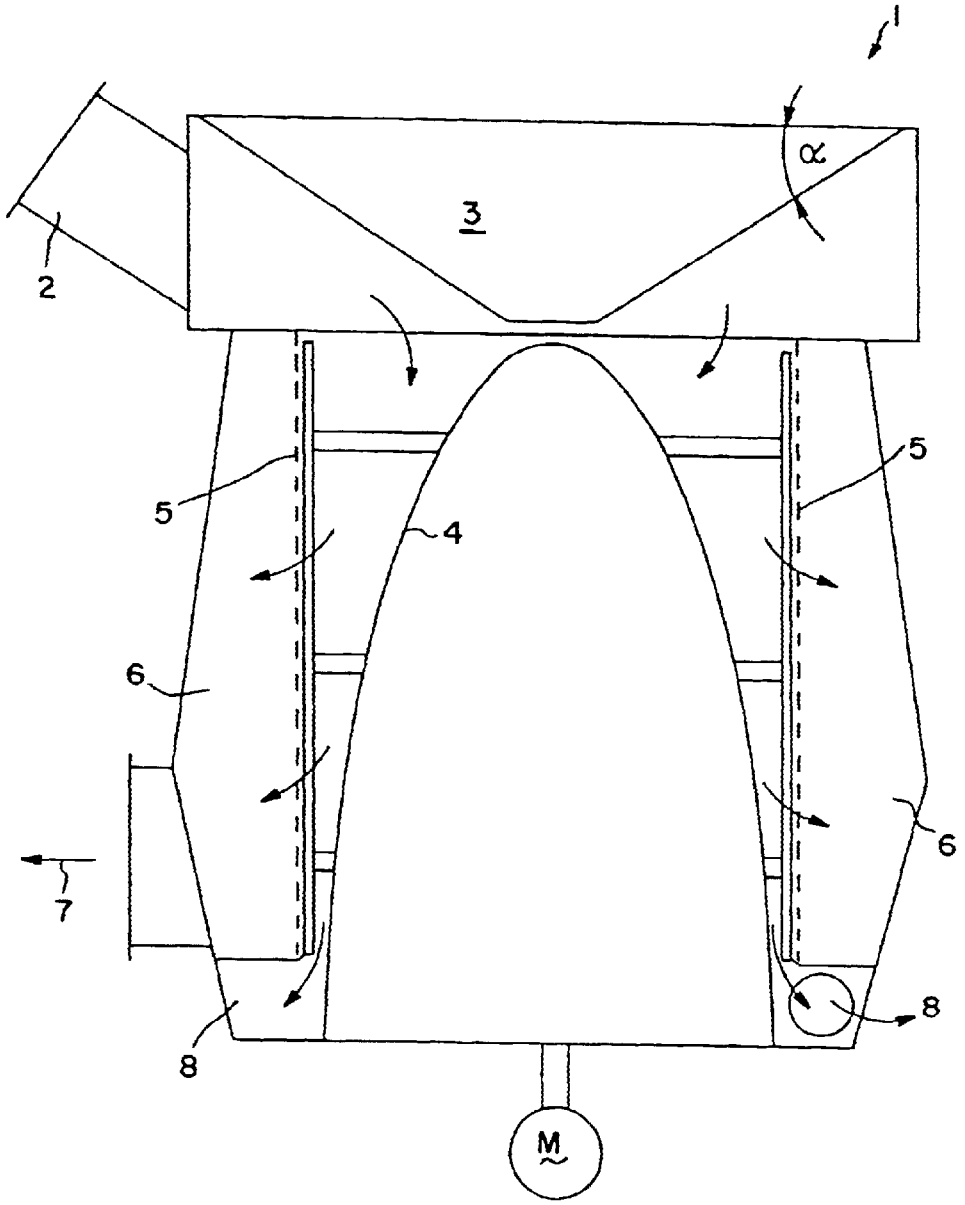
FIG. 2 is a cross-section view of a second embodiment of the invention.

FIG. 2 shows an alternate embodiment of a screen 1, with the infeed branch 2 being arranged such that the suspension is fed parallel to the surface 20' of the truncated cone 3. This means that the energy loss which normally exists in case of flow diversion can be avoided.

Figure 3:
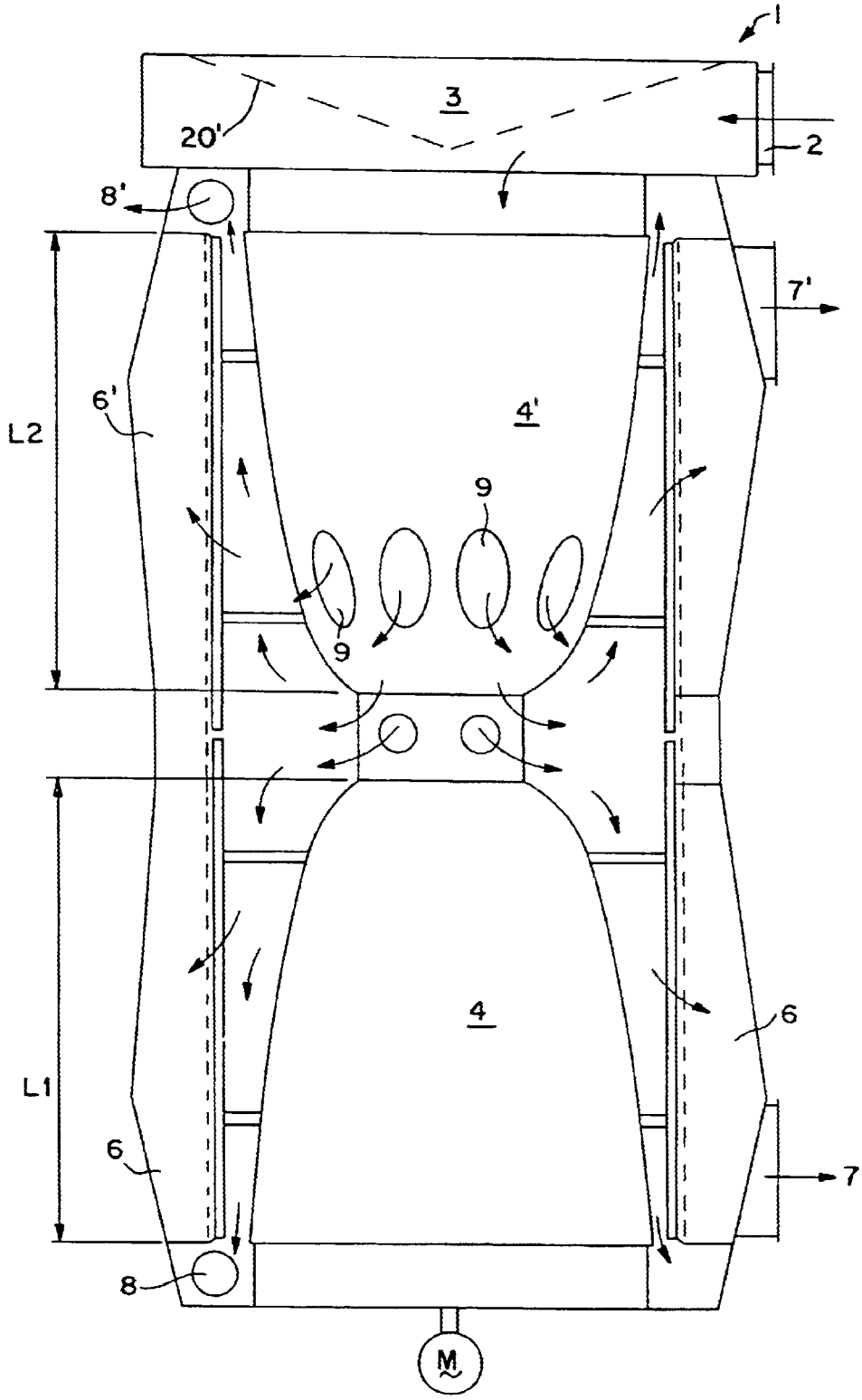
FIG. 3 is a cross-section view of a third embodiment of the invention.

The embodiment shown in FIG. 3 is used for high production rates. For this, the rotor is, for instance, designed as a double parabolic rotor 4, 4' or double-cone rotor. The reject discharge 8, 8' and the screen basket 5, 5' are also provided twice. Here, too, the accept chamber 6, 6' is a double cone, and this means in this case as well that the casing tapers approximately from the upper edge of the accept flow discharge (when the screen 1 is disposed vertically) toward the reject chamber. The pulp suspension is fed via infeed branch 2, and in the configuration shown, routed axially through the rotor. With this type of inflow, the height L1 of driven end portion of the rotor 4 is equal to or greater than height L2 of the free end portion of the rotor 4'. The suspension leaves rotor part 4', through which the flow takes place, through openings 9 at the center and is distributed in both directions. It passes through the screen basket 5, 5' into accept chamber 6, 6', the same as for a simple screen, this accept chamber being in this case also designed as a double cone. The reject flows both upwards and downwards and is in this case discharged from the machine via a reject chamber 8, 8'. In another configuration, the infeed may take place centrally from the side. There may be two accept discharges, one on top (7') and bottom (7) or a single one in the center. The screening device may be designed horizontally.

Figure 4:
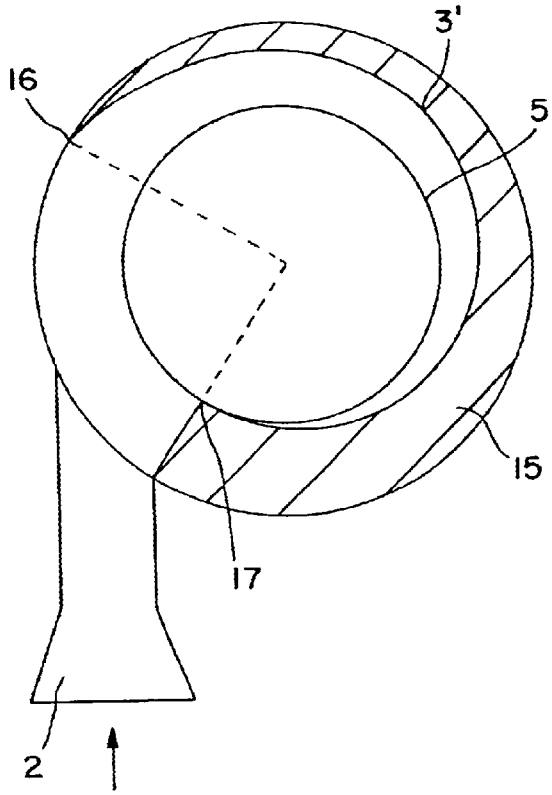
FIG. 4 is a top view, partly in phantom, of a fourth embodiment of the invention.

FIG. 4 shows another embodiment of the invention, where the installation 3' is a vertically extending sheet, which extends approximately 270°. This sheet 3' directs the pulp flow evenly from the inlet 2 into the screen basket 5 in spiral form. It can be seen that the sheet 3' starts at point 16 and then extends in spiral form around the center (the axis) until point 17. The space 15 between sheet 3' and the outer wall of the screen may be left empty. It is important that the flow area decreases continually and therefore an even flow velocity as far as possible is provided, which is adjusted to the infeed of the suspension into the screen basket 5.

Figure 5:
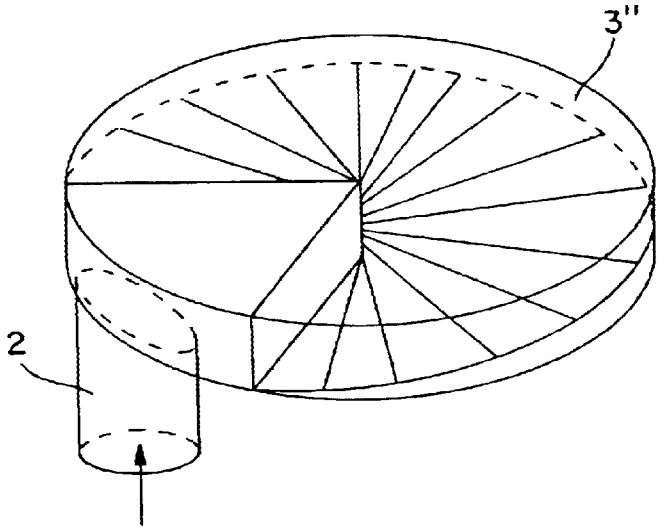
FIG. 5 is a perspective view, partly in phantom, of a fifth embodiment of the invention.
Figure 6:
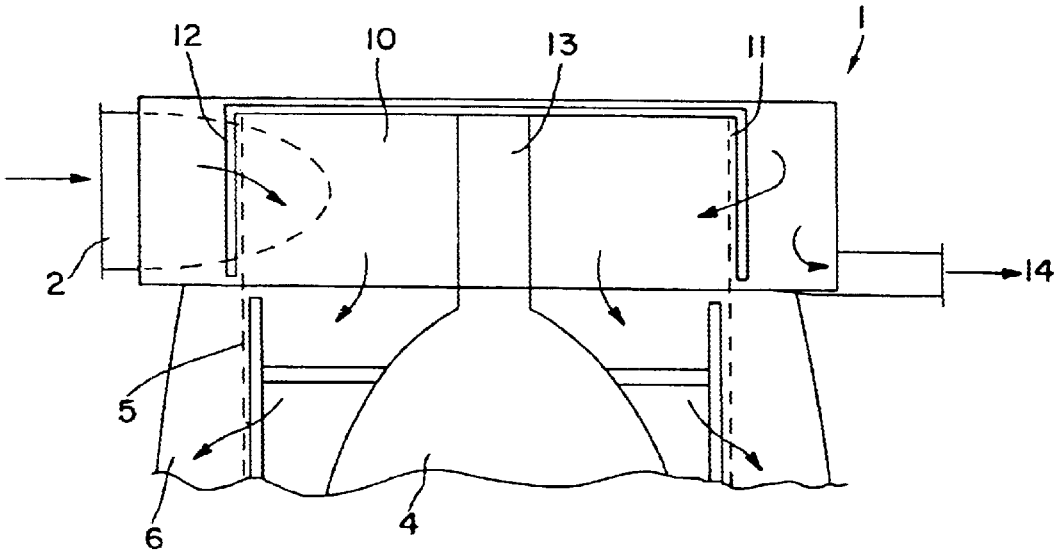
FIG. 6 is a cross-section view of a the top portion of a sixth embodiment of the invention.

FIG. 5 shows a perspective view of a further embodiment of the invention. Installation 3" is mounted on the top whereby the surface extends in spiral form in direction to the screen basket. The pulp suspension is directed from the infeed 2 directly into the screen basket along the surface showing to the screen basket. Also here is considered the suspension flow into the screen basket to achieve a constant flow velocity In this way energy losses will be kept at a minimum FIG. 6 now shows the upper part of screen 1 with an integrated preliminary screening. The pulp suspension is fed to the screen 1 via infeed branch 2. In order to discharge heavy particles in the area of the pre-screening, a pre-screening area 10 is provided in the upper part of screen 1, into which the suspension passes through a screen plate 11. This allows efficient removal of specifically heavy particles and large-surface contaminants, which result from dirty or very dirty pulps. There is a locked-in rotor 12 outside screen plate 11, this rotor being connected to rotor 4 via an extension 13. The heavy particles leave the pre-screening area through branch 14. Rotor 12 may be running in the pre-screening area 10 both in the infeed flow (as shown) or in the accept flow, which is then led to further fine screening in the lower area of the screen 1. If the rotor 12 runs in the infeed flow, then the rotating cleaner blades of the rotor 12 keep the highly abrasive heavy particles from hitting that surface of screen plate 11 and thereby damaging it.

The specifically heavy parts are thereby centrifuged outside. This allows to achieve longer useful life for the screen baskets In the pre-screening area, and on the other hand also to have a planned barrier in the form of the pre-screening basket as a consistent impediment for the heavy parts to pass into the centrifugal post-screening area. This means that the rotors, for the fact that they rotate in the first-stage accepts, are being loaded longer at the onflow edges and are therefore subject to lesser abrasion and energy consumption and can therefore be adjusted more closely to the surface of screen plate 5, without triggering damage to the rotor or screen plate surface. The separation of coarse and minor contaminants results in increased performance (throughput and effectiveness increase) in comparison to conventional screening machines. This variant can also be designed with a double-cone rotor for high production rates.

Figure 7:
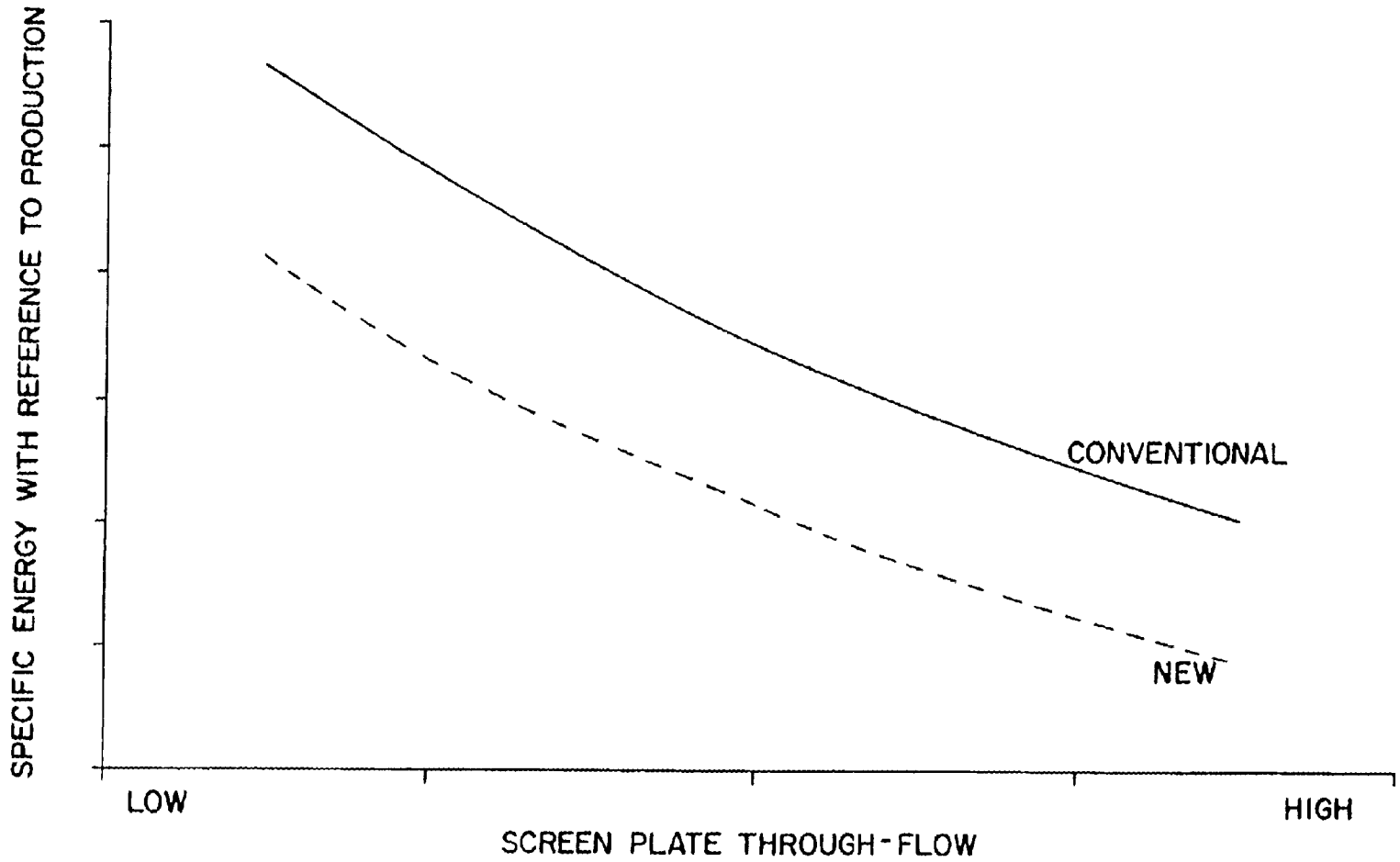
FIG. 7 is a graph showing the specific energy versus the screen plate flow.

FIG. 7 is a graph comparing the energy requirement with the screen plate through-flow, with one curve being shown for conventional screens and one for screens according to the invention.

Figure 8:
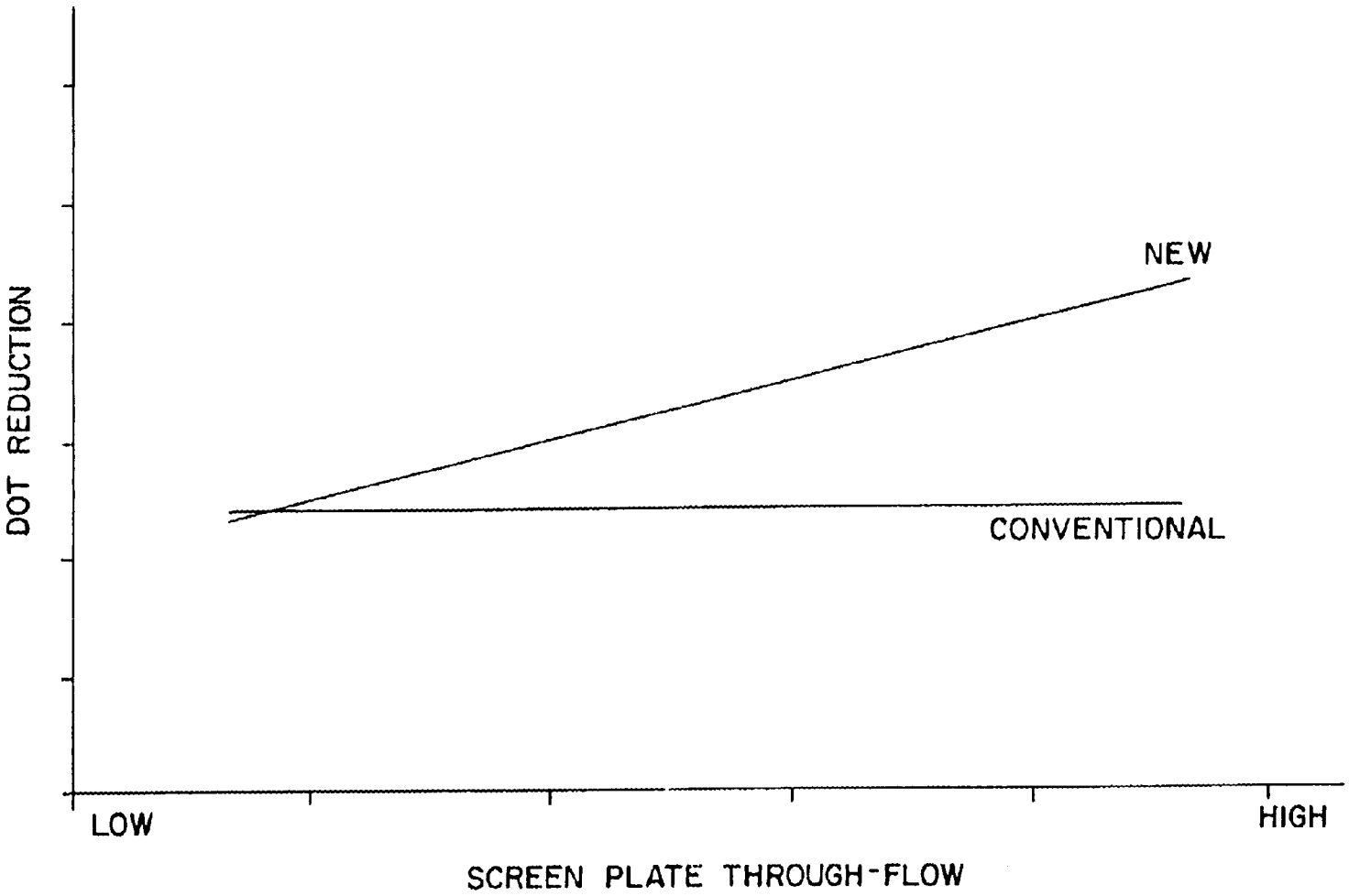
FIG. 8 a graph of the dots reduction versus the screen plate through flow.

FIG. 8 is a graph comparing the dot reduction with the screen plate through-flow. It can be seen here that with a conical installation in the infeed area, it was possible to improve the dot reduction substantially and to reduce the specific energy consumption at the same time.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. Screen for cleaning a pulp suspension comprising:

an infeed branch having an axis;

a rotatable rotor having a driven end and a free end; and a stationary installation disposed within an infeed area between the infeed branch and the free end of the rotor, the installation having a surface;

wherein the axis of the infeed branch is substantially parallel to the surface of the installation.

2. Screen for cleaning a pulp suspension comprising:

an infeed branch;

a rotatable rotor having a driven end and a free end;

a stationary, spiral-shaped installation disposed within an infeed area between the infeed branch and the free end of the rotor; and a screen basket disposed intermediate the installation and the rotor;

wherein the spiral-shape has a pitch selected such that the flow speed in the infeed area is kept constant over the entire screen basket.

3. Screen for cleaning a pulp suspension comprising:

an infeed branch defining an inlet diameter;

a rotatable rotor having a driven end and a free end;

a stationary installation disposed within an infeed area between the infeed branch and the free end of the rotor, the installation having a surface and defining a height; and a screen disposed intermediate the installation and the rotor;

wherein the infeed branch is adapted for directing the pulp suspension over substantially the full height of the surface of the installation and the installation is adapted for redirecting the pulp suspension evenly onto the screen.

4. The screen according to claim 3, wherein the installation is rotationally symmetrical.

5. The screen according to claim 4, wherein the installation has a shape selected from the group consisting of a cone, a truncated cone, a hemisphere, a spherical segment, a spherical segment between two parallel circles, a paraboloid, and a hyperboloid of two sheets.

6. The screen according to claim 4, wherein the installation is a cone or truncated cone having a cone angle substantially between 10° and 60°.

7. The screen according to claim 3, wherein the installation is arranged centrally.

8. The screen according to claim 3, further comprising a single accept chamber having a double-conical profile.

9. The screen according to claim 3, wherein the rotor has a driven end portion and a free end portion, each having a conical or parabolic shape with a wide end and an oppositely disposed narrow end, the narrow end of the free end portion being disposed adjacent the narrow end of the driven end portion.

10. The screen according to claim 9, a wherein the pulp suspension infeed is received axially through the rotor.

11. The screen according to claim 10, wherein the driven end portion of the rotor has a height L1 and the free end portion of the rotor has a height L2, where $L1 \geqq L2$.

12. The screen according to claim 11, wherein the pulp suspension infeed is received from the side proximate to the narrow ends of the driven and free end portions.

13. The screen according to claim 9, further comprising first and second accept discharges.

14. The screen according to claim 3, wherein the screen is disposed horizontally.

15. The screen according to claim 3, further comprising a screen basket disposed in the infeed area, the screen basket defining a pre-screening area and rotating together with the rotor.

16. The screen according to claim 15, further comprising rotating blades disposed in the pre-screening area.

17. The screen according to claim 16, wherein the rotating blades are arranged at different heights.

18. The screen according to claim 16, wherein the rotating blades are distributed over the circumference of the pre-screening area.

* * * * *

UNITED STATES PATENT AND TRADEMARK OFFICE

CERTIFICATE OF CORRECTION

PATENT NO. : 6,631,809 B2
DATED : October 14, 2003
INVENTOR(S) : Gabl et al.

It is certified that error appears in the above-identified patent and that said Letters Patent is hereby corrected as shown below:

Title page,
Item [30], Foreign Application Priority Data, please delete "(AU)" and replace with -- (AT) --.

Signed and Sealed this

Twenty-seventh Day of January, 2004

JON W. DUDAS
*Acting Director of the United States Patent and Trademark Office*